US010422515B2

(12) United States Patent
Noblitt

(10) Patent No.: US 10,422,515 B2
(45) **Date of Patent: *Sep. 24, 2019**

(54) METHODS AND SYSTEM FOR ILLUMINATING DECORATIONS

(71) Applicant: Daniel J. Noblitt, Scottsdale, AZ (US)

(72) Inventor: Daniel J. Noblitt, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/893,951

(22) Filed: Feb. 12, 2018

(65) Prior Publication Data

US 2018/0163953 A1 Jun. 14, 2018

Related U.S. Application Data

(62) Division of application No. 15/010,860, filed on Jan. 29, 2016, now Pat. No. 9,890,935.

(60) Provisional application No. 62/109,514, filed on Jan. 29, 2015.

(51) Int. Cl.

| | |
|---|---|
| ***F21V 19/00*** | (2006.01) |
| ***F21V 7/00*** | (2006.01) |
| ***F21Y 115/10*** | (2016.01) |
| *F21W 121/00* | (2006.01) |

(52) U.S. Cl.

CPC ..... *F21V 19/0055* (2013.01); *F21V 7/00* (2013.01); *F21W 2121/00* (2013.01); *F21Y 2115/10* (2016.08)

(58) Field of Classification Search

None

See application file for complete search history.

(56) References Cited

U.S. PATENT DOCUMENTS

2014/0204589 A1* 7/2014 Moon ..... F21V 7/10 362/310

FOREIGN PATENT DOCUMENTS

| | | | |
|---|---|---|---|
| GB | 2429514 | * | 2/2007 |
| GB | 2429514 A | | 2/2007 |

* cited by examiner

*Primary Examiner* — Ashok Patel

(74) *Attorney, Agent, or Firm* — Daniel J. Nobilitt

(57) ABSTRACT

Methods and apparatus for illuminating decorations according to various aspects of the present invention may comprise a light source and a diffuser. A connector may connect the light source to the decoration. A reflector may reflect light from the light source towards an anticipated observer.

5 Claims, 2 Drawing Sheets

METHODS AND SYSTEM FOR ILLUMINATING DECORATIONS

CROSS-REFERENCES TO RELATED APPLICATIONS

This application claims the benefit of U.S. Provisional Patent Application No. 62/109,514, filed Jan. 29, 2015, and is a divisional application of U.S. Nonprovisional patent application Ser. No. 15/080,860, filed Jan. 29, 2016.

BACKGROUND

People illuminate decorations, such as pumpkins caved into jack-o-lanterns during Halloween. A small candle placed in the jack-lantern typically provides the light. The candle is often visible from the front of the jack-o-lantern, leading the viewer to be distracted by the candle itself instead of the carved art of the jack-o-lantern. The concentrated light of the candle also ruins photographs of the jack-o-lantern, especially at night.

SUMMARY

Methods and apparatus for illuminating decorations according to various aspects of the present invention may comprise a light source and a diffuser. A connector may connect the light source to the decoration. A reflector may reflect light from the light source towards an anticipated observer.

BRIEF DESCRIPTION OF THE DRAWING

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

Various aspects of the present invention may be described in terms of functional block components and various processing steps. Such functional blocks may be realized by any number of components configured to perform the specified functions and achieve the various results. For example, exemplary embodiments of the present invention may employ various light sources, reflectors, diffusers, and connectors that may carry out a variety of functions. In addition, various aspects of the present invention may be practiced in conjunction with any number of different types of environments and applications, and the systems and methods described are merely exemplary applications for the invention.

Figure 1:
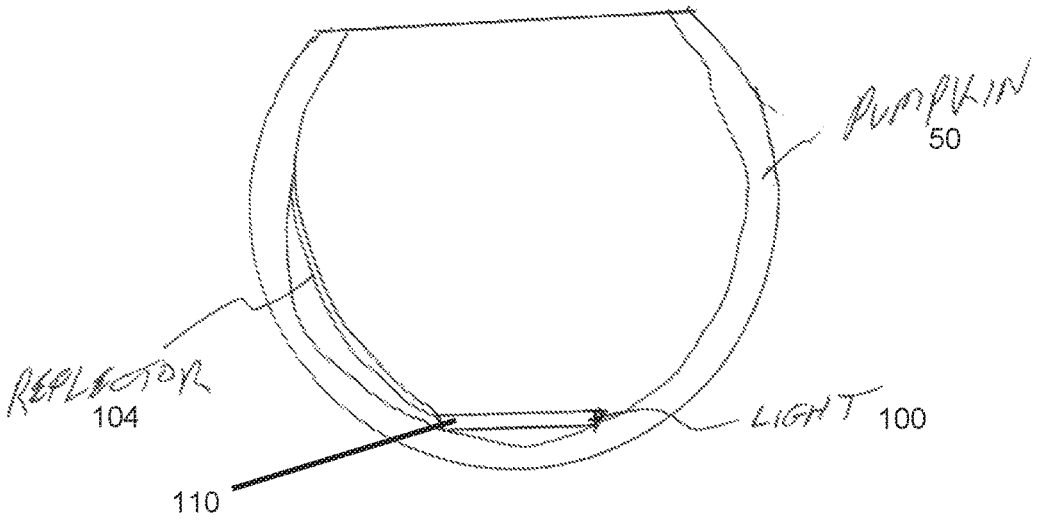
FIG. 1 is a cross-section side view of a jack-o-lantern with a light source resting on the bottom of the jack-o-lantern.
Figure 2:
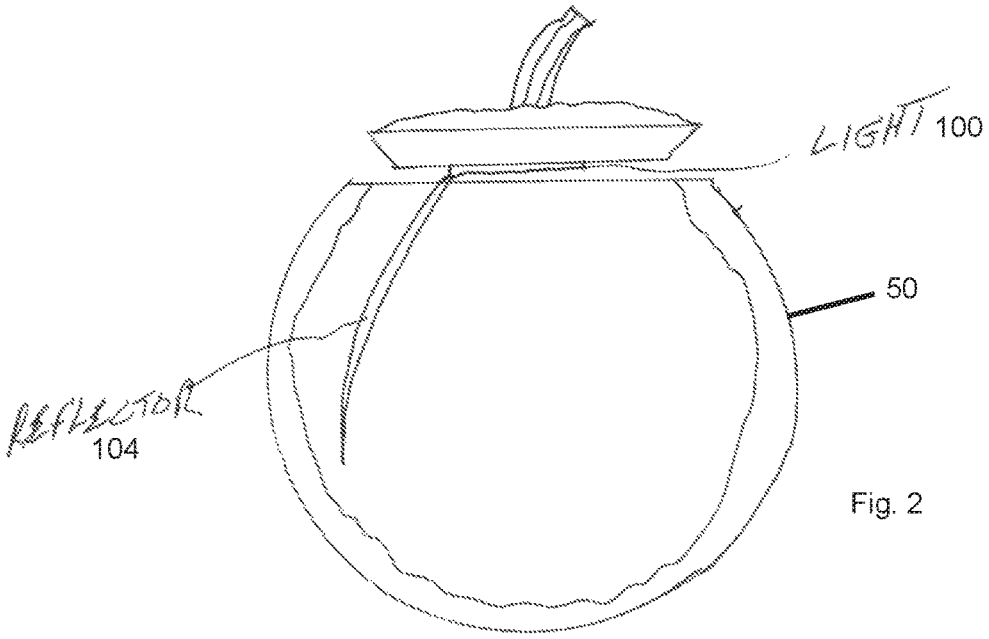
FIG. 2 is a cross-section side view of a jack-o-lantern with a light source connected to the top of the jack-o-lantern.
Figure 3:
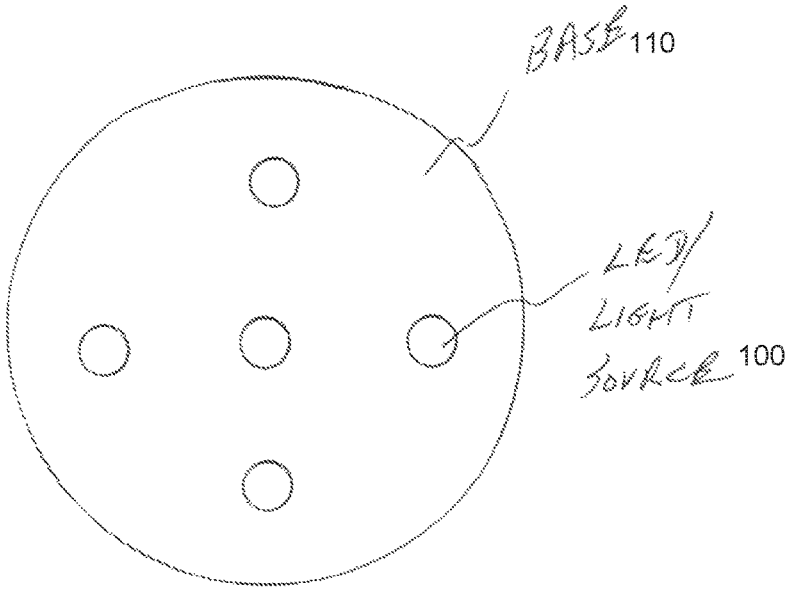
FIG. 3 is top view of the front of a base having multiple LEDs.
Figure 4:
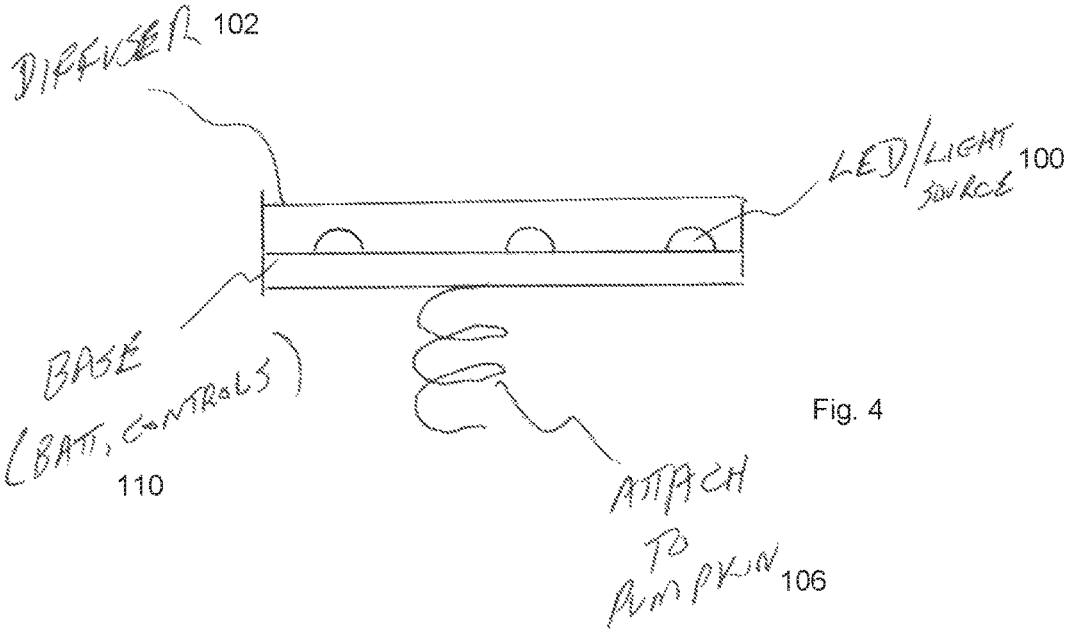
FIG. 4 is a cross section side view of a base with a light source, a diffuser, and a connector.

Referring to FIGS. 1-4, methods and apparatus for illuminating decorations according to various aspects of the present invention may diffuse light substantially throughout the interior of a decoration, such as a Halloween jack-o-lantern made from a pumpkin 50, evenly dispensing and lighting the inside of it for viewing purposes. The methods and apparatus may operate in conjunction with a light source 100 attached to the inside of the decoration. The light may be diffused via a light diffuser 102 and/or reflector 104. The light source 100 may be hidden inside the jack-o-lantern from direct view when looking at the jack-o-lantern's from an ordinary observer's perspective.

The light source 100 generates light to illuminate the decoration. The light source 100 may comprise any appropriate system for generating light, such as an incandescent, fluorescent, or LED light, or other light-providing objects, such as a glow stick.

In the present exemplary embodiment, the light source 100 comprises one or more LEDs powered by one or more batteries and disposed on the front side of a base 110. The light source 100, base 110, and batteries may comprise a relatively flat unit to make the unit less visible from outside the decoration. For example, the flat unit may be no more than an inch high, or less than a half-inch high, or less than a quarter-inch high.

The light generated by the light source 100 may also be of any desired color. The light source 100 may be activated and/or deactivated manually or automatically, for example in response to darkness and/or a timer. For the jack-o-lantern application, the light source 100 may generate a relatively low intensity light, such as the intensity provided by one conventional candle or a few candles, such as one to six candles. In various embodiments, the light source 100 generates about 0.1 to about 20 candelas, for example in the range of about 0.5 to about 10 candelas, or about 0.5 to about 3 candelas. The light intensity may vary for different applications and environments.

A connector 106 connects the light source 100 to the inside of the decoration. The connector 106 may comprise any appropriate connector for the particular application and environment. The connector 106 may comprise an adhesive, hook-and-loop fastener, screw, clip, clamp, and/or hook. In the present embodiment, the connector 106 is attached to the back side of the base 110 housing the light source and batteries.

The connector 106 of the present embodiment may comprise a piercing connector that may pierce the pumpkin 50 and be driven into the pumpkin's interior wall, such as a cork-screw that may be twisted into the pumpkin's interior wall. Alternatively, the piercing connector may comprise one or more prongs, hooks, blades, pins, rods, and the like.

The light diffuser 102 diffuses the light from the light source 100, for example to provide diffuse light within the decoration. The diffuser 102 may comprise any suitable material that diffuses light, such as a translucent plastic or glass. In various embodiments, the diffuser 102 may filter the light to produce a particular color. In the present embodiment, the diffuser 102 is interposed over the light source 100. The diffuser 102 may be coupled to the base 110 and cover the light source 100 so that light from the light source 100 is transmitted through the diffuser 102.

Various embodiments of the present technology may further comprise the reflector 104 to enhance the reflection of light towards a viewer looking at the jack-o-lantern. The reflector 104 may be any size or shape reflect light in a desired direction. For example, in one embodiment, the reflector 104 may be contoured to fit the interior curvature of the pumpkin 50, but may also be flat, convex, or any other suitable configuration.

The reflector 104 may comprise any suitable reflective material, such as fabric, glass, plastic, metal, or other such reflective materials. In one embodiment, the reflector 104 comprises projection screen material, such as aluminized flexible material for high contrast or a white surface with small glass beads for high brilliance.

The reflector 104 may be attached to the light source 100, for example via the base 110 using a tether, hinge, or other connection, or it may be separate or separable from the base 110 and light source 100. The reflector 104 may be flexible to facilitate insertion into the pumpkin 50 followed by deployment, for example to be placed against the rear side of the pumpkin (opposite the jack-o-lantern's face or other carving). The reflector 104 may be any color. In one embodiment, the reflector's 104 color approximates the color of a pumpkin's interior, such as light orange to mimic the natural color of the inside wall of a jack-o-lantern.

In operation, the light source 100 may be attached to the item to be illuminated using the connector 106. The reflector 104 may be positioned to reflect light from the light source 100 in a desired direction, such as towards an anticipated observer. The light source 100 may be activated, which generates light. The diffuser 102 diffuses and transmits the light to illuminate the decorative item, and the reflector 104 reflects incident toward the viewer.

In one embodiment using a jack-o-lantern, the light source 100 may be attached to the interior of the jack-o-lantern in a location hidden from the view of the anticipated ordinary viewer. For example, the connector may be twisted into the top portion (FIG. 2) or bottom portion (FIG. 1) of the jack-o-lantern's interior. Alternatively, the light source 100 may be placed on the bottom of the jack-o-lantern without using a connector 106. The reflector 104 may be inserted into the jack-o-lantern and placed against the rear interior wall of the jack-o-lantern to reflect light towards the front wall. The light source 100 may be activated, which transmits light through the diffuser 102. The diffuser 102 bathes the interior of the jack-o-lantern with diffuse light. The reflector 104 reflects incident light towards the front of the jack-o-lantern, where it passes through the carving to the viewer. A light orange reflector 104, diffuser 102, and/or light source 100 may enhance the natural light appearance of the jack-o-lantern that might be generated by a traditional light source like a candle.

In the foregoing specification, the invention has been described with reference to specific exemplary embodiments. Various modifications and changes may be made, however, without departing from the scope of the present invention as set forth in the claims. The specification and figures are illustrative, not restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The terms "comprise", "comprises", "comprising", "having", "including", "includes" or any variations of such terms, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

The invention claimed is:

1. A light apparatus for illuminating a jack-o-lantern, comprising:

a base;

an LED mounted on a front side of the base; and a piercing connector mounted on a back side of the base, wherein the piercing connector comprises at least one corkscrew.

2. The light apparatus of claim 1, further comprising a reflector attached to the base.

3. The light apparatus of claim 2, wherein the reflector's color approximates the color of pumpkin interior.

4. The light apparatus of claim 1, wherein the LED generates about 0.5 to about 10 candelas.

5. The light apparatus of claim 1, wherein the LED generates about 0.5 to about 3 candelas.

* * * * *